US005966770A

United States Patent [19]

Byrne et al.

[11] Patent Number: 5,966,770

[45] Date of Patent: Oct. 19, 1999

[54] SLICER BLADE CLEANING TOOL

[76] Inventors: Kevin T. Byrne, 136 Sycamore Ave.; David Tully, 616 Palmer Ave., both of Middletown, N.J. 07748

[21] Appl. No.: 09/078,988

[22] Filed: May 14, 1998

[51] Int. Cl.[6] ..... A47L 13/08; A47L 13/04

[52] U.S. Cl. ..... 15/105; 15/236.01; 15/236.05; 30/172

[58] Field of Search ..... 15/105, 111, 113, 15/236.01, 236.05, 236.02; 30/169, 172; 76/81

[56] References Cited

U.S. PATENT DOCUMENTS

| | | | |
|---|---|---|---|
| 36,309 | 8/1862 | Schweizer et al. | 15/111 |
| D. 172,537 | 7/1954 | Hill | 15/236.01 |
| 1,354,709 | 10/1920 | Williams | 30/169 |
| 2,133,087 | 10/1938 | Ericsson | 15/236.01 |
| 2,556,797 | 6/1951 | Carlson | 15/236.01 |
| 2,576,325 | 11/1951 | Wood | 15/111 |
| 4,414,700 | 11/1983 | Burns | 15/111 |
| 4,542,554 | 9/1985 | Wallerstein | 15/236.02 |
| 4,724,568 | 2/1988 | Englehardt | 15/105 |
| 4,768,254 | 9/1988 | Bell | 15/236.01 |
| 4,890,351 | 1/1990 | Wilson | 15/236.01 |
| 5,317,779 | 6/1994 | Hoagland | 15/111 |
| 5,440,811 | 8/1995 | Challis | 30/169 |
| 5,455,981 | 10/1995 | Wiese | 15/236.02 |
| 5,479,673 | 1/1996 | Carton | 15/111 |

*Primary Examiner*—Mark Spisich
*Assistant Examiner*—Theresa T. Snider
*Attorney, Agent, or Firm*—Charles I. Brodsky

[57] ABSTRACT

A slicer blade cleaning tool including a handle having a grasping area at a first end of a length and breadth to be easily held by the fingers and palm of one hand, and also having a downwardly extending prolongation and attached scraper at an opposite end, with the prolongation and scraper being constructed of a heavy plastic able to withstand forces downwardly and upwardly applied to the prolongation and to the scraper as the scraper is held against a rotating slicing blade in cleaning cheese and/or meat residue remaining after a slicing or cutting action is completed.

10 Claims, 1 Drawing Sheet

SLICER BLADE CLEANING TOOL

FIELD OF THE INVENTION

This invention relates to commercial-grade electric slicing machines and, more particularly, to such machines as find frequent use in the kitchens of restaurants, in the appetizing departments of supermarkets and other food stores, and in delicatessens.

BACKGROUND OF THE INVENTION

As is known, State and/or Local Boards of Health typically require that the blade of such slicer machines be regularly cleaned. Whether such cleaning occurs once each day—at the end of the work-day, for example—or frequently during the day, the typical manner for cleaning the blade has been found generally inadequate, leaving much to be desired. As will be appreciated, this results from the way in which the slicer blade is typically cleaned.

More specifically, the conventional manner of cleaning the blade is to first remove the blade-guard, take a cloth or linen rag and bunch it up, dipping it in an ammonia and water solution. The wetted rag is then pressed against the blade in an attempt to clean it while the blade rotates electrically. Experience has shown, however, that whether the bunched-up rag be thus used to clean heavy cheese or lunch meat, or otherwise from the blade, the rag tends to bind-up and snag about the blade—frequently causing injuries to the fingers holding the rag if they do not let go in time when the catching of the rag occurs in this manner. Similar attempts of cleaning, using sponges soaked in this type of soapy solution, oftentimes fare no better due to their being grabbed and then ripped apart as the slicer blade rotates, whether the blade rotates in a vertical plane, or rotates at an upward angle of some 30–45°, or so. When it is appreciated that the cleaning of the blade many times takes place just to prevent the products from intermingling—as where the slicer blade is cleaned after cutting heavy cheeses as muenster, and after cutting spreadable meats as liverwurst, the problem of the shredding of the cleaning rag, and the possible injuries to the fingers which hold it against the blade become even more understandable. Experience has shown that it is not unusual for a worker to be cut on the sharp blade of the slicer while attempting to clean the blade, requiring medical suturing to close the resulting wound.

OBJECTS OF THE INVENTION

It is an object of the present invention, therefore, to develop a new and improved way to clean these slicing machines which do not suffer the disadvantages of the prior art.

It is an object of the invention, also, to provide a safe way of cleaning the slicer blade of these commercial grade machines, which substantially increases the degree of protection afforded to the worker charged with the responsibility of carrying out the cleaning task.

It is another object of the present invention to provide this improved method of cleaning, and at a cost which can easily be borne by the restaurant owner, the supermarket or other store operator, and the delicatessen proprietor, for example.

It is a further object of the invention to provide such a new and improved method of cleaning the slicer blade which eliminates the need for using any cloth or linen rag that might otherwise bind, and possibly do damage to, the slicer blade as it is electrically rotating.

SUMMARY OF THE INVENTION

As will become clear from the following description, these objects are satisfied through the use of a slicer blade cleaning tool incorporating a handle having a grasping area at a first end of a length and breadth to be easily held by the fingers and palm of one hand. In accordance with a first aspect of a preferred embodiment of the invention, the handle also includes a downwardly extending prolongation at a second, opposite end, along with a scraper having a substantially flat bottom edge secured to the downwardly extending prolongation. Additionally, in accordance with this preferred embodiment, both the prolongation and the scraper are constructed of a material able to sustain downward forces and upward forces applied to them when pressing the bottom edge of the scraper against the slicer blade in cleaning the blade, as the blade rotates in the vertical or slanted angle plane typical in slicing machine operations. Further, according to the invention, the scraper is releasably secured to the downwardly extending prolongation, and is of a generally rectangular construction having a pair of bevelled edges at its lengthwise extensions—each of which terminates in a substantially flat bottom edge of a material to withstand the downward and upward forces applied to the prolongation when cleaning the slicer blade.

In this respect, as will be seen, the slicer blade cleaning tool is designed to orient the scraper so that either one of its bevelled edges is arranged to bear against the slicer blade in cleaning it, at any given instant of time. To allow for further cleaning of the slicer blade—without damaging its generally utilized nickel plating surface—the handle of the cleaning tool also includes a second prolongation, at the same, opposite end of the handle, at which an abrasive pad is releasably secured (as by an adhesive layer)—and, preferably, with the second prolongation also extending downwardly from the handle. With the scraper constructed of a heavy-duty plastic, and with the handle being designed with an ability for its "hanging" when not being used, the slicer blade cleaning tool can be manufactured for sale for as little as $20.00, or so, in a package having, for example, four such scraper blades and a 30-day supply of abrasive pads. With the construction of the invention, and packaged in this manner, experience has shown that the cleaning tool could be used as much as 25–30 times each day, without needing any replenishment of the abrasive pads and/or the scraper blades packaged as a unit, over 2–3 months of continuous use.

In this manner, the above objects of the invention are achieved—along with others almost equally as important. More particularly, employing the cleaning tool of the invention this way has been found to place less of a strain on the slicer blade in cleaning it, thereby putting less stress on the machine motor than is associated with the cleaning of the blade through the prior art use of rags or other material—as a result, any tendency to burn-out the motor is reduced. Likewise, besides being a simpler way of cleaning the slicer blade, the invention to be described offers the added feature of reducing cross-contamination between cheeses and various meats, either in responding to the same order, or in-between orders.

BRIEF DESCRIPTION OF THE DRAWING

These and other features of the present invention will be more clearly understood from a consideration of the following description, taken in connection with the accompanying drawings, in which.

DETAILED DESCRIPTION OF THE INVENTION

Figure 1:
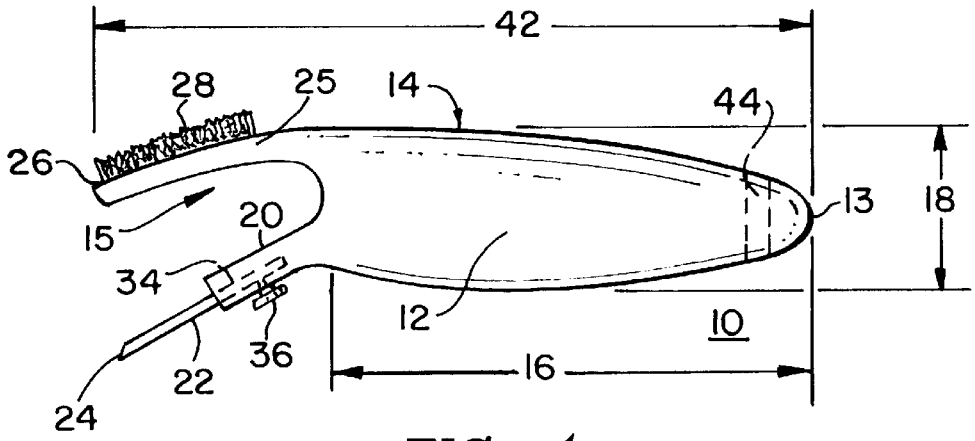
FIG. 1 is a left-side profile view of a preferred embodiment of the invention, a right-side profile view being a mirror image.
Figure 2:
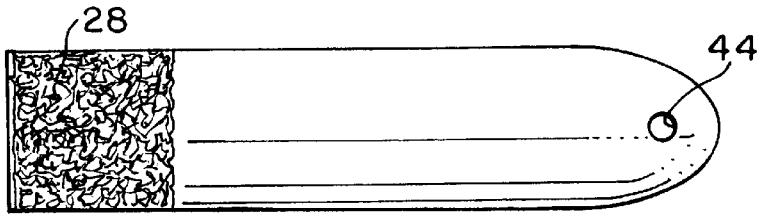
FIGS. 2 and 3 are top and bottom views, respectively, of the slicer blade cleaning tool of FIG. 1.

In the drawings, the slicer blade cleaning tool 10 is shown as including a handle 12 having a grasping area 14 at one end 13 of a length 16 and breadth 18 to be easily held by the fingers and palm of one hand. The handle 12 also includes a downwardly extending prolongation 20 at a second, opposite end 15, along with a scraper 22 having a substantially flat bottom edge 24 secured to the prolongation 20. In accordance with a preferred embodiment of the invention, the handle 12 also includes a second prolongation 25 at the end 15, to a top surface 26 of which an abrasive pad 28 is secured—releasably, in a preferred embodiment, either by an adhesive securement or by a conventional hook-and-loop type arrangement, as VELCRO. As will be understood, the pad 28 is of a material composition so as not-to-scratch the nickel plating of the slicer blade when the pad is dipped into an ammonia-water, or similar, solution to wipe-clean the slicer blade, after the scraper is first used to remove the cheese or meat residue on the blade that remains after the slicing or cutting operation.

Figure 3:
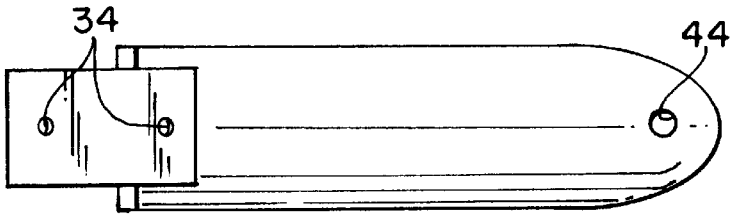
Figure 4:
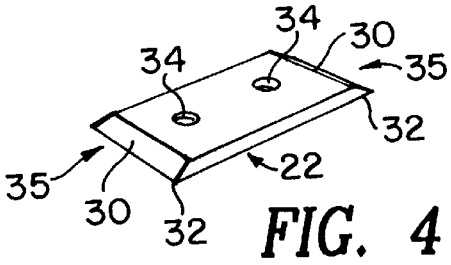
FIGS. 4 and 5 pictorially represent the slicer blade scraper and abrasive pad of the cleaning tool of the invention, respectively.
Figure 5:
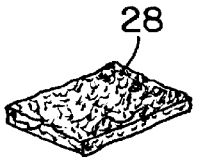

Thus, the scraper 22 may be of a generally rectangular construction, having a pair of bevelled edges 30 at the lengthwise extensions 32 thereof, each of which is constructed to have a substantially flat bottom edge. More particularly, such bevelled edges 32—as well as the scraper 22 itself—are, in accordance with the preferred embodiment of the invention, constructed of a material able to sustain downward forces and upward forces applied to the prolongation 20 and to the scraper 22 as the scraper 22 is pressed against the slicer blade in cleaning it, as the blade electrically or otherwise rotates. As illustrated in FIGS. 1, 3, and 4, furthermore, the scraper 22 is provided with an eyelet aperture 34 adjacent its opposite lengthwise ends 35, to receive a rivet or removable screw hold 36 in releasably securing the scraper 22 to the prolongation 20—so as to allow first one end of the scraper 22, then the other end, to be pressed against the slicer blade, as either end wears through repeated cleanings. In this manner, the scraper 22 is held by the user against the rotating slicer blade in cleaning it—with the worker holding his hand some 6–8 inches from the blade in so doing (with such dimension representing the overall length 42 of the tool handle 12). The handle 12 is also provided with a hole 44 adjacent its first end 13, for hanging the cleaning tool from a hook, nail or screw, when the cleaning tool is not in use. In a preferred construction, both the handle 12 and the scraper 22 may be constructed of a heavy-duty plastic composition.

In operation, with the slicer blade rotating vertically, or at a slanted angle, the tool 10 is held by the fingers and palm of one hand in a manner to apply the pressure from the scraper edge 30 against the slicer blade surface to scrape any cheese or meat from its surface. The abrasive pad 28 is then dipped into the ammonia-water or soapy solution, to rub any residue that may remain on the slicer blade in the further cleaning of it. Once the cleaning operation is completed, the tool 10 is re-hung to await further use—be it at the end of the day, or upon the completion of the next use of the slicing machine, where desired.

While there have been described what are considered to be preferred embodiments of the present invention, it will be readily appreciated by those skilled in the art that modifications can be made without departing from the scope of the teachings herein of utilizing a slicer blade cleaning tool incorporating a scraper having a substantially flat bottom edge at a downwardly extending prolongation, and of a strength to withstand force applied to the edge when pressing it against the slicer blade in cleaning the blade of any accumulated residue. For at least such reason, therefore, resort should be had to the claims appended hereto for a true understanding of the scope of the invention.

We claim:

1. A slicer blade cleaning tool comprising:

a handle having a grasping area at a first end of a length and breadth to be easily held by the fingers and palm of one hand, and also having a downwardly extending prolongation at a second, opposite end thereof;

a scraper having a substantially flat bottom edge secured to said downwardly extending prolongation at said second end;

with said prolongation and said scraper being constructed of a material able to sustain downward and upward forces applied to said prolongation and to said scraper when pressing said bottom edge of said scraper against a slicer blade in cleaning said slicer blade as said blade rotates;

with said handle also having a second prolongation at said second, opposite end of said handle; and an abrasive pad secured to a top surface of said second prolongation.

2. The slicer blade cleaning tool of claim 1 wherein said scraper is releasably secured to said downwardly extending prolongation at said second end.

3. The slicer blade cleaning tool of claim 2 wherein said scraper is of a generally rectangular construction having a pair of bevelled edges at lengthwise extensions thereof.

4. The slicer blade cleaning tool of claim 3 wherein both of said pair of bevelled edges terminate in substantially flat bottom edges of a material able to withstand downward and upward forces applied to said prolongation when cleaning said slicer blade.

5. The slicer blade cleaning tool of claim 4 wherein there is also include a pair of eyelet apertures within said scraper for releasably securing said scraper to bear either end of said pair of bevelled edges against said slicer blade at any given instant of time.

6. The slicer blade cleaning tool of claim 1 wherein said abrasive pad is releasably secured to said top surface of said second prolongation.

7. The slicer blade cleaning tool of claim 1 wherein said abrasive pad is adhesively secured to said top surface of said second prolongation.

8. The slicer blade cleaning tool of claim 1 wherein said second prolongation downwardly extends from said handle at said second, opposite end.

9. The slicer blade cleaning tool of claim 8, said handle also including means, at said first end, for hanging said cleaning tool when not in use.

10. The slicer blade cleaning tool of claim 1 wherein said scraper is constructed of a heavy-duty plastic composition.

* * * * *